US008994557B2

(12) United States Patent
Stegmaier et al.

(10) Patent No.: US 8,994,557 B2
(45) Date of Patent: Mar. 31, 2015

(54) MODULAR COLLISION WARNING APPARATUS AND METHOD FOR OPERATING THE SAME

(75) Inventors: Peter A. Stegmaier, Ponte Capriasca (CH); Urs M. Rothacher, Thalwil (CH)

(73) Assignee: Safemine AG, Baar (CH)

( * ) Notice: Subject to any disclaimer, the term of this patent is extended or adjusted under 35 U.S.C. 154(b) by 393 days.

(21) Appl. No.: 13/515,191

(22) PCT Filed: Dec. 11, 2009

(86) PCT No.: PCT/CH2009/000395

§ 371 (c)(1),
(2), (4) Date: Oct. 5, 2012

(87) PCT Pub. No.: WO2011/069267

PCT Pub. Date: Jun. 16, 2011

(65) Prior Publication Data

US 2013/0021146 A1 Jan. 24, 2013

(51) Int. Cl.
*G08G 1/16* (2006.01)
*H01Q 1/32* (2006.01)

(52) U.S. Cl.
CPC ..... *G08G 1/162* (2013.01); *H01Q 1/3233* (2013.01); *H01Q 1/3275* (2013.01)
USPC ..... 340/903; 340/902; 701/300; 701/301; 342/455

(58) Field of Classification Search
CPC ... G01S 13/93; G01S 13/931; G01S 13/9332; G01S 13/9353; G01S 13/9357; G01S 13/936; G01S 13/9371; G01S 13/9382; G08G 1/16; G08G 1/161; G08G 1/163; G08G 1/166
USPC ..... 340/902, 903; 701/300, 301; 342/455
See application file for complete search history.

(56) References Cited

U.S. PATENT DOCUMENTS 4,893,356 A 1/1990 Waters
5,068,654 A 11/1991 Husher (Continued)

FOREIGN PATENT DOCUMENTS

DE 19715458 A1 10/1998
DE 10260167 A1 7/2004

(Continued)

OTHER PUBLICATIONS

International Preliminary Report on Patentability for PCT/CH2009/000395, dated Jun. 21, 2012.

(Continued)

*Primary Examiner* — Andrew Bee
(74) *Attorney, Agent, or Firm* — Marshall, Gerstein & Borun LLP

(57) ABSTRACT

A collision warning apparatus, to be mounted to a vehicle, has a roof mount unit (40), to be fixed to the vehicle's roof, as well as a cabin mount unit (41) to be located in the driver's cabin. A digital transmission line (42) is provided for connecting the two. The roof mount unit (40) houses the antennas as well as the analog circuitry of the apparatus, while the cabin mount unit (41) comprises a display (26). The data sent through the transmission line (42) is digital, which allows to make the transmission line thin and flexible. The roof mount unit (40) has a magnet (43) and batteries (48) mounted in its base section (46), with the lighter components, in particular the antennas (30*a*, 31*a*, 32*a*) located in its head section (47).

25 Claims, 3 Drawing Sheets

(56) References Cited

U.S. PATENT DOCUMENTS

| | | | | |
|---|---|---|---|---|
| 5,983,161 | A | 11/1999 | Lemelson et al. | |
| 6,128,559 | A * | 10/2000 | Saitou et al. | 701/23 |
| 6,437,688 | B1 * | 8/2002 | Kobayashi | 340/435 |
| 6,611,755 | B1 | 8/2003 | Coffee et al. | |
| 6,679,702 | B1 * | 1/2004 | Rau | 434/29 |
| 6,700,493 | B1 | 3/2004 | Robinson | |
| 2002/0022927 | A1 | 2/2002 | Lemelson et al. | |
| 2002/0198660 | A1 * | 12/2002 | Lutter et al. | 701/301 |
| 2004/0113774 | A1 | 6/2004 | Wilson | |
| 2004/0217851 | A1 | 11/2004 | Reinhart | |
| 2004/0217869 | A1 | 11/2004 | Bouchard et al. | |
| 2006/0025894 | A1 * | 2/2006 | O'Connor et al. | 701/1 |
| 2006/0046648 | A1 | 3/2006 | DiFonzo et al. | |
| 2006/0071632 | A1 * | 4/2006 | Ghabra et al. | 320/108 |
| 2006/0208169 | A1 * | 9/2006 | Breed et al. | 250/221 |
| 2006/0240790 | A1 * | 10/2006 | Timmis et al. | 455/127.4 |
| 2006/0244573 | A1 | 11/2006 | Wendler | |
| 2006/0273967 | A1 | 12/2006 | Gat et al. | |
| 2007/0008091 | A1 | 1/2007 | Takenaga et al. | |
| 2007/0013497 | A1 | 1/2007 | Watanabe | |
| 2007/0184852 | A1 * | 8/2007 | Johnson et al. | 455/456.1 |
| 2007/0203646 | A1 * | 8/2007 | Diaz et al. | 701/213 |
| 2007/0204804 | A1 | 9/2007 | Swanson et al. | |
| 2007/0279250 | A1 * | 12/2007 | Kume et al. | 340/903 |
| 2008/0055154 | A1 | 3/2008 | Martucci et al. | |
| 2008/0077327 | A1 * | 3/2008 | Harris et al. | 701/301 |
| 2008/0258890 | A1 * | 10/2008 | Follmer et al. | 340/439 |
| 2009/0125177 | A1 * | 5/2009 | Tanaka et al. | 701/29 |
| 2009/0212935 | A1 * | 8/2009 | Luo | 340/467 |
| 2009/0237293 | A1 | 9/2009 | Sakuma | |
| 2009/0259400 | A1 | 10/2009 | Coats et al. | |
| 2010/0174486 | A1 * | 7/2010 | Wakabayashi | 701/214 |
| 2010/0220189 | A1 | 9/2010 | Yanagi | |

FOREIGN PATENT DOCUMENTS

| | | | |
|---|---|---|---|
| DE | 102008017129 | A1 | 10/2009 |
| EP | 1843161 | A2 | 10/2007 |
| FR | 2886440 | A1 | 12/2006 |
| GB | 2452829 | A | 3/2009 |
| JP | 11220726 | A | 8/1999 |
| JP | 2005029338 | A | 2/2005 |
| JP | 2007285485 | A | 11/2007 |
| WO | WO-00/79502 | A1 | 12/2000 |
| WO | WO02/50796 | | 6/2002 |
| WO | WO-03/001474 | A2 | 1/2003 |
| WO | WO-2004/021546 | A2 | 3/2004 |
| WO | WO-2004/047047 | A1 | 6/2004 |
| WO | WO-2006/079165 | A1 | 8/2006 |
| WO | WO-2007/000686 | A2 | 1/2007 |
| WO | WO-2011/069266 | A1 | 6/2011 |
| WO | WO-2011/069267 | A1 | 6/2011 |
| WO | WO-2011/130861 | A1 | 10/2011 |
| WO | WO-2011/153646 | A1 | 12/2011 |
| WO | WO-2011/153652 | A2 | 12/2011 |

OTHER PUBLICATIONS

Invitation to Pay Additional Fees for PCT/CH2009/000395, dated Sep. 21, 2010.

Written Opinion for PCT/CH2009/000395, dated Jun. 21, 2012.

Written Opinion for PCT/CH2009/000395, dated Nov. 24, 2010.

International Preliminary Report on Patentability for PCT/CH2009/000395, dated Jun. 12, 2012.

International Search Report for PCT/CH2009/000395, dated Nov. 24, 2010.

Written Opinion for PCT/CH2009/000395, dated Nov. 24, 2012.

Written Opinion for PCT/CH2009/000394 dated Nov. 22, 2010.

International Preliminary Report on Patentability in PCT/CH2009/000394 dated Jun. 12, 2012.

Partial International Search Report in PCT/CH2009/000395 dated Sep. 21, 2010.

International Search Report for PCT/CH2009/000394 dated Nov. 22, 2010.

* cited by examiner

MODULAR COLLISION WARNING APPARATUS AND METHOD FOR OPERATING THE SAME

TECHNICAL FIELD

The invention relates to a collision warning apparatus comprising a positioning receiver, a radio transceiver and an operator information unit.

BACKGROUND ART

It has been proposed to use GNSS-devices (GNSS=global navigation satellite system, such as GPS) on board of vehicles and other objects, such as cranes, to generate proximity warnings in order to reduce the risk of collisions. Such a system is e.g. described in WO 2004/047047. The system is based on apparatus mounted to the objects. Each apparatus comprises a GNSS receiver, a radio transceiver for wireless exchange of the positional data with the other apparatus, and a display device for outputting proximity warnings.

Typically, this type of apparatus is fixedly mounted to vehicles.

DISCLOSURE OF THE INVENTION

The problem to be solved by the present invention is to provide an apparatus that can be mounted easily to vehicles, as well as a method for operating such an apparatus.

This problem is solved by the apparatus and method of the independent claims.

Accordingly, the apparatus comprises:

- A positioning receiver for a radio based positioning system, such as a GNSS-receiver, in particular a GPS-receiver. This positioning receiver comprises a first antenna and first analog and first digital circuitry.
- A radio transceiver for sending and receiving radio messages to/from other collision warning apparatus. The radio transceiver comprises a second antenna, and second analog and second digital circuitry.
- An operator information unit, such as a display device, for issuing collision warnings to the user.
- A control unit processing data from the positioning receiver and the radio transceiver (31) in order to generate the collision warnings.

Further, the device has roof mount unit, a cabin mount unit and a digital transmission line:

- The roof mount unit is structured and adapted to be mounted on the roof of a vehicle. It contains the first and second antenna as well as, at least, the first and second analog circuitry.
- The cabin mount unit is structured and adapted to be mounted in the cabin of the vehicle. It contains the operator information unit. It may e.g. also contain at least part of the digital electronics of the positioning system, of the radio transceiver and/or of the control unit.
- The digital transmission line consists of cabling connecting the roof mount unit and the cabin mount unit. It is adapted to exchange digital data between them and may also carry power.

Hence, the roof mount unit is mounted on the roof of the vehicle, and the cabin mount unit is mounted in the passenger cabin of the vehicle.

In other words, the present invention is based on the idea that all analog and radio frequency (RF) circuitry is arranged in the roof mount unit, while the communication between the roof mount unit and the cabin mount unit is digital. Since the transmission line between the two units is digital, it is not easily affected by damping, and it does not require extended shielding and can therefore be comparatively thin, such that it e.g. can easily be guided through a slit at the top of the vehicles window.

This design is especially suited for apparatus to be mounted on vehicles visiting a safety area. For example, if the vehicles in a mine or large construction site are monitored by an collision warning system of this type, a vehicle visiting the site can quickly and easily be equipped with a collision warning apparatus as described above.

BRIEF DESCRIPTION OF THE DRAWINGS

The invention will be better understood and objects other than those set forth above will become apparent when consideration is given to the following detailed description thereof. Such description makes reference to the annexed drawings, wherein.

MODES FOR CARRYING OUT THE INVENTION

Definitions

The term GNSS stands for "Global Navigation Satellite System" and encompasses all satellite based navigation systems, including GPS and Galileo.

The term "radio based positioning system" stands for a GNSS or for any other type of positioning system using radio signals, such as a pseudolite system.

Figure 1:
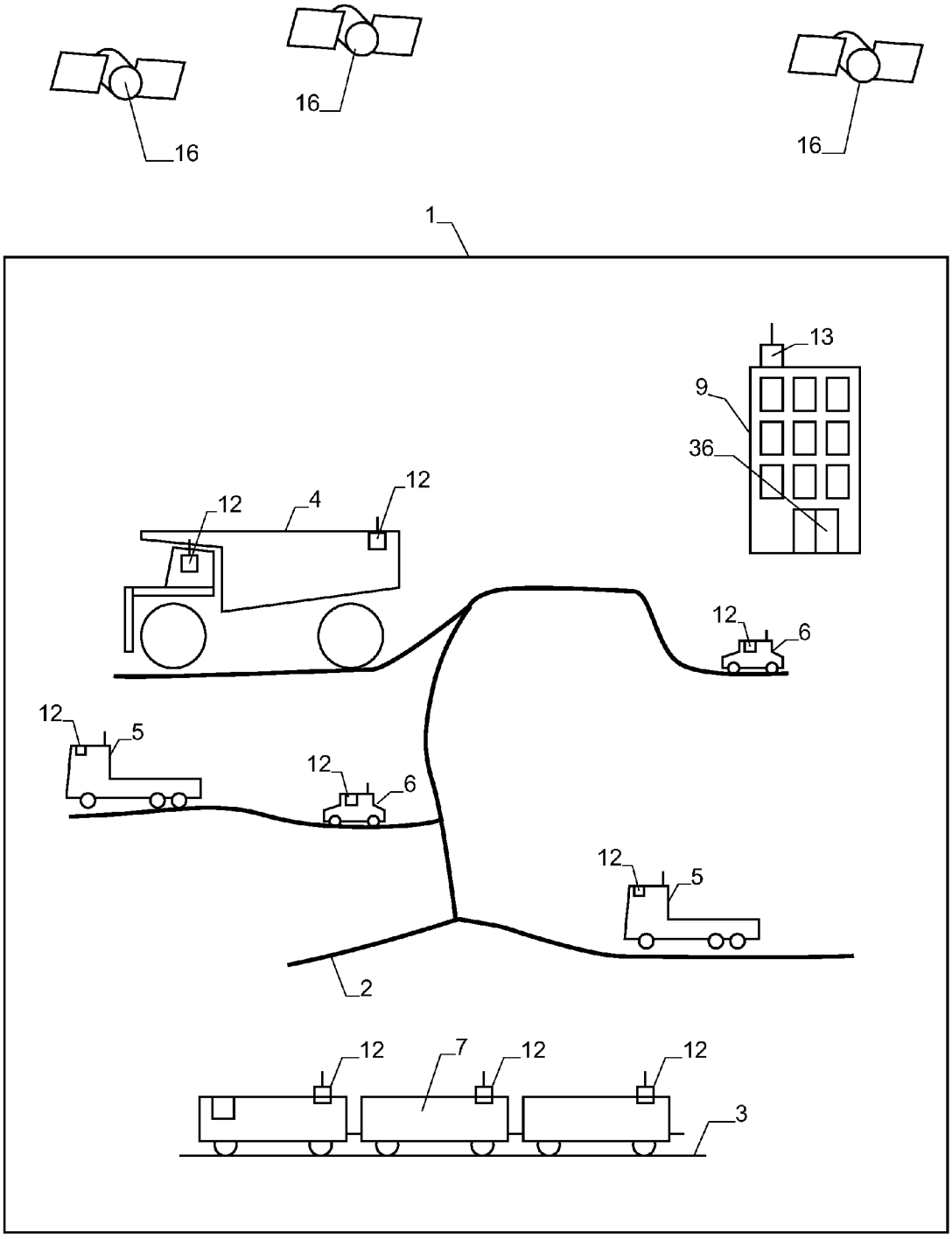
FIG. 1 shows a site under surveillance of a collision warning system.

Introduction:

FIG. 1 schematically depicts a site 1, such as a surface mine or a large construction site, to be monitored by the present system. Typically, such a site covers a large area, in the case of a surface mine e.g. in the range of square kilometers, with a network of roads 2 and other traffic ways, such as rails 3. A plurality of objects is present in the mine, such as:

- Large vehicles, such as haul trucks 4, cranes or diggers. Vehicles of this type may easily weigh several 100 tons, and they are generally difficult to control, have very large breaking distances, and a large number of blind spots that the driver is unable to visually monitor.
- Medium sized vehicles 5, such as regular trucks. These vehicles are easier to control, but they still have several blind spots and require a skilled driver.
- Small vehicles 6. Typically, vehicles of this type weigh 3 tons or less. They comprise passenger vehicles and small lorries.
- Trains 7.

A further type of object within the mine is comprised of stationary obstacles, such as temporary or permanent buildings, open pits, boulders, non-movable excavators, stationary cranes, deposits, etc.

The risk of accidents in such an environment is high, specifically under adverse conditions as bad weather, during night shifts, etc. In particular, the large sized vehicles can easily collide with other vehicles, or obstacles.

For this reason, the mine 1 is equipped with a collision warning system that allows to generate proximity warnings, thereby reducing the risk of collisions and accidents.

The collision warning system comprises collision warning apparatus 12, one of which is mounted to each vehicle or obstacle. In addition, the system can comprise a central server 13, whose role is explained below.

Collision Warning Apparatus

Figure 2:
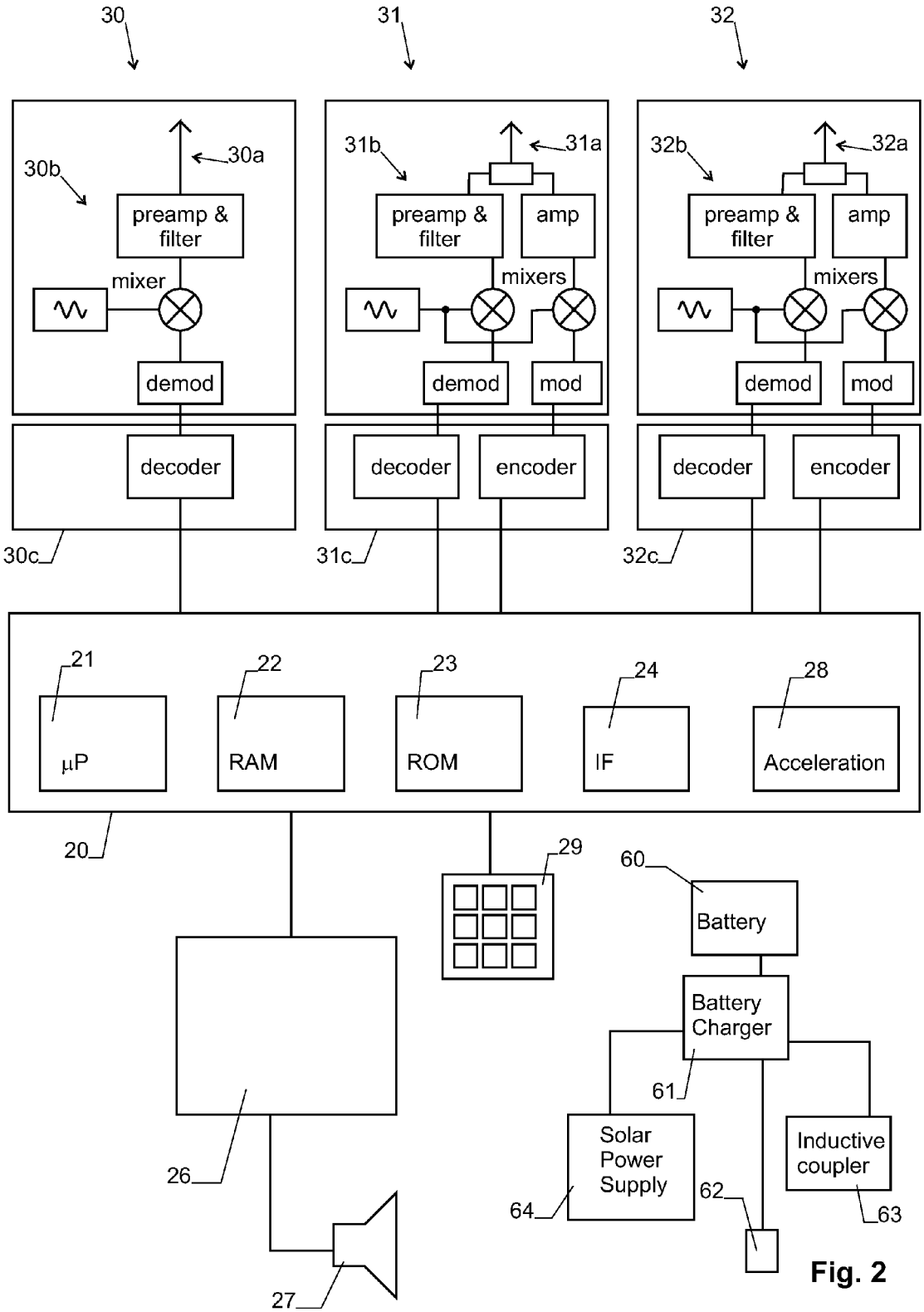
FIG. 2 is a block circuit of a collision warning apparatus.

FIG. 2 shows a block circuit diagram of an example of a single collision warning apparatus 12. The apparatus comprises:

- A control unit 20 having a microprocessor 21, memory (RAM 22, ROM 23) and interface circuitry 24 as known to the skilled person.
- An operator information unit, e.g. formed by a display 26, for displaying messages and information. For example, display 26 can be a LCD screen and/or can comprise a plurality of light sources suitable to convey two-dimensional images or symbols to the user. The operator information unit can further or alternatively comprise a sound source 27, such as a loudspeaker or buzzer for emitting acoustic signals.
- Two or three radio communication units 30, 31, 32.

A first radio communication unit 30 is a positioning receiver for a radio based positioning system. It comprises a first antenna 30*a*, first analog circuitry 30*b*, and digital receiver circuitry 30*c*. First analog circuitry 30*b* can e.g. comprise a preamplifier, filters, a mixer and a demodulator. First digital circuitry 30*c* can e.g. comprise circuitry for analyzing the data from the demodulator in order to derive the position of the apparatus.

A second radio communication unit 31 is a radio transceiver for sending and receiving radio messages to/from other collision warning apparatus. Advantageously, the second radio communication unit 31 is adapted to directly communicate with the second radio communication units 31 of other apparatus 12, without the help of any intermediary transmitters. It comprises a second antenna 31*a*, second analog circuitry 31*b* and second digital circuitry 31*c*. Second analog circuitry 31*b* allows for two-way communication, and therefore, in addition to first analog circuitry 30*b*, further comprises a modulator, and outgoing mixer and an outgoing amplifier. Second digital circuitry 31*c* is e.g. structured to error check and decode incoming data and to encode outgoing data. Second radio communication unit 31 is typically a general-purpose non-cellular communication device for sending information from one collision detection apparatus to another collision detection apparatus.

A third radio communication unit 32 is optional. It is a cellular phone transceiver, such as a GMS or UMTS transceiver, adapted to send and receive messages through a cellular phone network. Alternatively, or in addition thereto, third radio communication unit 32 may comprise a receiver for communicating through another wireless data transmission network, such as WiFi, WiFi Mesh, WiMax, BigZee, etc. It comprises a third antenna 32*a*, third analog circuitry 32*b* and third digital circuitry 32*c*. Third analog circuitry 31*b* allows, as second analog circuitry 32*b*, for two-way communication, and therefore basically comprises the same type of components. Third digital circuitry 32*c* is e.g. structured to detect incoming SMS messages addressed to the given monitoring apparatus, and error check and decode them, to encode and address outgoing SMS messages, and to handle communication with the cellular network. It may also carry other forms of digital information exchange and/or voice.

The various components of the three radio communication units 30, 31, 32 are known to the skilled person and need not be explained in detail here.

Collision warning apparatus 12 advantageously comprises a rechargeable battery 60. A battery charger 61 comprises circuitry for charging battery 60. Battery charger 61 can draw power from at least one power source. Such power sources can e.g. be

- a power plug 62 for directly connecting device 12 to an external power supply;
- an inductive coupler 63 comprising a coil adapted to generate electrical current from an alternating magnetic field generated by an external primary coil; such inductive power couplers are known to the skilled person; and/or
- a solar power supply 64 mounted at the outer surface of device 12 or in a separate unit electrically connected to device 12.

Battery 60 and the components 61-64 can be used to feed power to roof mount unit 40 (described below), display unit 41 (described below) and/or control unit 20. The various units can also have separate power supply means.

Operation of the Apparatus:

The operation of the collision warning apparatus 12 can be basically as in conventional systems of this type, such as e.g. described in WO 2004/047047 and need not be described in detail herein.

In short, in a simple approach, each device obtains positional data derived from a signal from positioning receiver 30. This positional data allows to determine the position of the device and is stored in a "device status dataset". The device status dataset also contains a unique identifier (i.e. an identifier unique to each apparatus or device 12 used on the same site).

The device status dataset is emitted as a radio signal through radio transceiver 31. With the same transceiver 31, the device receives the corresponding signals from neighboring apparatus or devices 12 and, for each such neighboring apparatus 12, it calculates the relative distance d by subtracting its own coordinates from those of the neighboring device.

Proximity Warnings:

Proximity warnings can be generated by means of various algorithms. Examples of such algorithms are described in the following.

In a very simple approach, it can be tested if the absolute value of the relative distance d is below a given threshold. If yes, a proximity warning can be issued on display 26 and/or by loudspeaker 27. This corresponds to the assumption that a circular volume in space is reserved for each object. The radius of the circular volume attributed to an object can e.g. be encoded in its device status dataset.

A more accurate algorithm can e.g. take into account not only the relative position, but also the driving velocities and directions of the vehicles.

An improvement of the prediction of collisions can be achieved by storing data indicative of the size and/or shape of the vehicle that a monitoring device is mounted to. This is especially true for large vehicles, which may have non-negligible dimensions. In a most simple embodiment, a vehicle can be modeled to have the same size in all directions, thereby defining a circle/sphere "covered" by the vehicle. If these circles or spheres of two vehicles are predicted to intersect in the near future, a proximity warning can be issued.

Instead of modeling an object or vehicle by a simple circle or sphere, a more refined modeling and therefore proximity prediction can be achieved by storing the shape (i.e. the bounds) of the vehicle in the dataset. In addition, not only the shape of the vehicle, but also the position of the positioning receiver 30 (or its antenna 30*a*) in respect to this shape or bounds can be stored in memory 22, 23.

Other Functions:

In addition to issuing proximity warnings as described above, the present apparatus can provide other uses and functions.

In one embodiment, which is particularly useful if the device is only temporarily installed on a visiting vehicle as described above, the apparatus can issue a warning when it leaves the site or enters a "forbidden area" of the site. This can e.g. happen when a user of the apparatus forgets to return the apparatus when leaving the site or tries to steal it.

This type of warning can be generated by executing the following steps:

1) In a first step, control unit 20 obtains the position of the apparatus by means of positioning receiver 30.

2) In a second step, control unit 20 compares this position to a predefined geographical area. This geographical area can e.g. be stored in memory 22, 23 and describes the area where the apparatus is allowed to be operated. If it is found that the position is not within the geographical area, the following step 3 is executed:

3) A warning is issued. This warning can e.g. be displayed on display 26 or issued as a sound by acoustic signal source 27. Alternatively, or in addition thereto, the warning can be sent, by means of third radio communication unit 32, to central server 13, together with the current position and identity of the apparatus. Then, the warning can be displayed by central server 13 and brought to the attention of personnel that can then take any necessary steps.

Another application of third radio communication unit 32 is to send messages from central server 13 to any apparatus or device 12. Such messages are received by apparatus or device 12 and displayed on display 26 or replayed by acoustic signal source 27. This e.g. allows to issue warnings, alerts or information to the driver operating the vehicle.

Operator information unit 26, 27 can also issue further information, in addition to collision warnings. For example, control unit 20 can be adapted to issue, on operator information unit 26, 27, the following further information:

- parameters depending on the location of the apparatus, such as the current position, a local speed limit, a map of the surroundings, or warnings relating to local hazards;
- a radio channel to be used for communication;
- parameters depending on speed, such as a warning when a speed limit is exceeded.

Furthermore, control unit 20 can have an "alert mode", which can be activated by a user, e.g. by pressing an alert button on a keyboard 29 and/or by voice control. It can e.g. be used to indicate that the person using the apparatus is in need of urgent help or needs all activity around it to be stopped immediately. The device status dataset comprises a flag indicative of whether the device is in alert mode. Another apparatus or device receiving a device status dataset that indicates that the sender is in alert mode may take appropriate action. For example, the central control room operator can be informed, closeby machinery can be shut down, etc.

The present system can also be used for generating automatic response to the presence of a vehicle or person at a certain location. For example, when a pedestrian vehicle with an apparatus 12 approaches a gate, such as actuator-operated door 36 of building 9, that door can open automatically. Similarly, an entry light can switch to red or to green, depending on the type of object that an apparatus 12 is attached to, or a boom can open or close. This can be achieved by mounting a receiver device to a selected object (such as a door, a gate or an entry light). The receiver device is equipped with a radio receiver adapted to detect the proximity of monitoring devices. When the receiver device detects the proximity of an apparatus 12, it actuates an actuator (such as the door, gate, boom or entry light) after testing access rights of the object attributed to the apparatus. For example, the actuator may be actuated depending on the type of the object that the apparatus is attached to. This type is transmitted as part of the device status dataset of the apparatus.

Acceleration Detector

In an advantageous embodiment, apparatus 12 comprises an acceleration detector 28. This acceleration detector 28 can be used to reduce the energy consumption of the apparatus. Since first radio communication unit 30 (positioning receiver) is one of the major power drains, first radio communication unit 30 can have a "disabled mode" where it is not operating and an "enabled mode" where it is operating. When control unit 20 detects an acceleration by means of acceleration detector 28, it puts first radio communication unit 30 into its enabled state to obtain the current position of the device. Otherwise, it puts first radio communication unit 30, after a predetermined amount of time, into its disabled state. In addition to this, to account for the unlikely event that no acceleration is measured even though the apparatus 12 is moving, control unit 20 can be adapted to put first radio communication unit 30 into its enabled state at regular intervals in order to perform sporadic position measurements.

In addition or alternatively to switching first radio communication unit 30 between a disabled an enabled state, other parts of apparatus 12 can be switched between an idle and an active state in response to signals from acceleration detector 28. In general terms, apparatus 12 can have an "idle state" and an "active sate", wherein, in said idle state, apparatus 12 has a smaller power consumption than in said active state. Control unit 20 is adapted to put apparatus 12 into its active state upon detection of an acceleration by acceleration detector 28, while the apparatus is e.g. brought back to its inactive state if no acceleration has been detected for a certain period of time.

Apparatus Design

Figure 3:
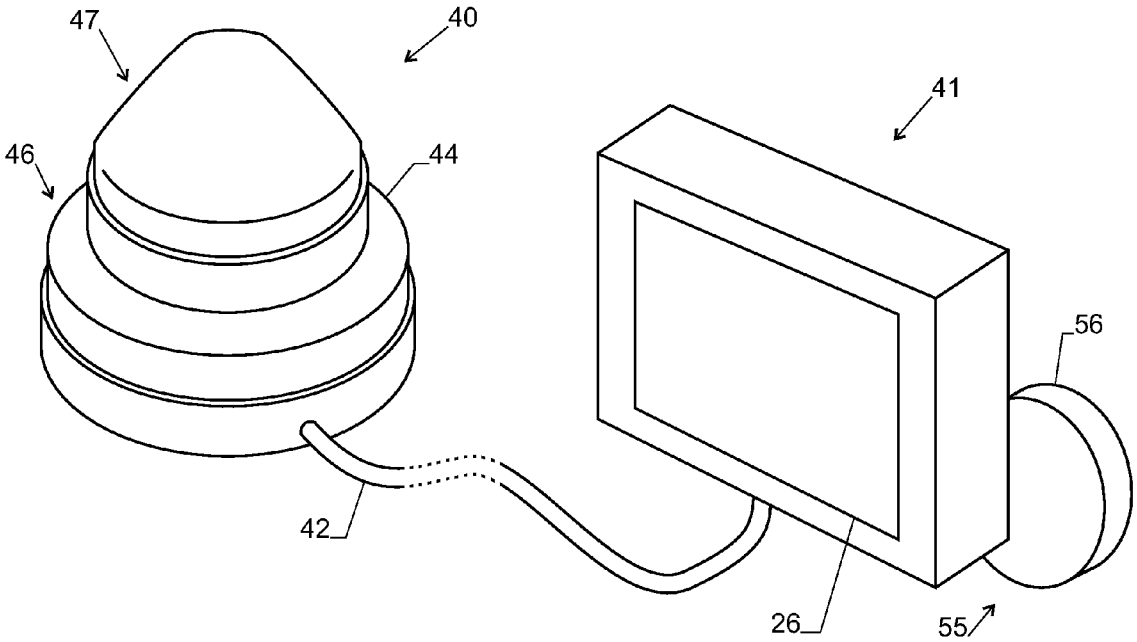
FIG. 3 shows a roof mount unit, a cabin mount unit and a transmission line connecting the two.
Figure 4:
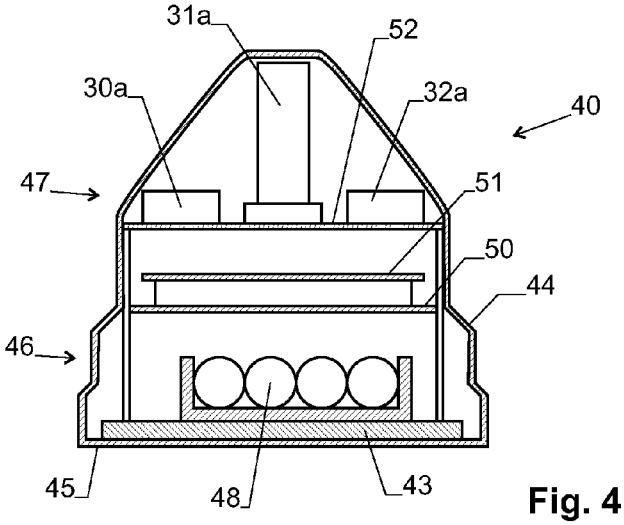
FIG. 4 is a sectional view of the roof mount unit of FIG. 3.

The physical design of the apparatus 12 is shown in FIGS. 3 and 4. It comprises a roof mount unit 40, a display unit 41 and a digital transmission and power line 42 connecting them.

As mentioned above, roof mount unit 40 is structured and adapted to be mounted to the roof of a vehicle. It can e.g. be equipped with an attachment (in the following called the "first attachment" for distinguishing it from a similar attachment of cabin mount unit 41) adapted to mounting the roof mount unit to the vehicle roof in quick and simple manner. The first attachment can e.g. be a clamp or a suction cup, but advantageously it is a magnet 43 (FIG. 4), in particular a permanent magnet, of sufficient strength for affixing roof mount unit 40 to the steel roof of a vehicle.

Roof mount unit 40 comprises a housing 44, which has a flat base 45, which comes to rest on the vehicle's roof. It has a base section 46 and a head section 47, with base section 46 being located between base 45 and head section 47. As can best be seen in FIG. 4, first attachment or magnet 43 is part of base section 46. Further, base section 46 comprises a set of batteries 48 for supplying power to the components in roof mount unit 40 and in some embodiments also to the display. On the other hand, first, second and third antenna 30*a*, 31*a*, 32*a* are mounted in head section 47. The circuitry of head unit 40 is arranged on two printed circuit boards 50, 51, either in base section 46 or head section 47 or both. This design has the advantage that the heavy components of roof mount unit 40, in particular the batteries 48, are mounted close to the vehicle's roof, while the light components, namely the antennas, are located further away from the roof, which reduces the risk of toppling while improving signal reception by the antennas.

The circuitry on circuit boards 50, 51 comprises at least the first, second and third analog circuitry 30*b*, 31*b*, 32*b* of the radio communication units 30, 31, 32.

A metal plate 52 is arranged between the antennas 30*a*, 31*a*, 32*a* and the circuit boards 50, 51 for shielding the antennas from electric noise from the circuitry on the boards.

Cabin mount unit 41 comprises a second attachment 55, such as a clamp or suction cup 56, adapted to mount unit 41 within the passenger cabin of the vehicle, in plain view of the driver, such as to the dashboard or windshield. It further comprises display 26 and sound source 27 in addition to any user operated controls.

Typically, control unit 20, which processes the signals from the communication units 30, generates the proximity warnings therefrom, and controls the operation of display 26, is arranged in cabin mount unit 41. The first, second and third digital circuitry 30*c*, 31*c*, 32*c* of the radio communication units 30, 31, 32 can be arranged in roof mount unit 40, cabin mount unit 41 or partially in both.

In an alternative embodiment, all or part of control unit 20 may also be located in roof mount unit 40, with cabin mount unit 41 e.g. only comprising the circuitry for driving display 26.

The whole apparatus may be powered by the batteries 48 of roof mount unit 47. Alternatively, cabin mount unit 41 may be equipped with its own batteries or be provided with an adaptor for drawing power from the vehicle. In yet another embodiment, the batteries 48 in roof mount unit 41 can be dispensed with if power is supplied through the cables of transmission line 42 from cabin mount unit 41 to roof mount unit 40.

Transmission line 42 is a wire-bound transmission line having sufficient number of cables for transmitting the signals and, if necessary, a shielding.

Digital transmission line 42 can be wire-bound, i.e. be formed by one or more wires. In some embodiments, the transmission line 42 may also be a wireless link, such as a Bluetooth link.

Signal Strength Triangulation:

Under adverse conditions, e.g. when one or more satellite signals are blocked, e.g. by obstacles, first radio communication unit 30 (positioning receiver) of a given apparatus 12 may not be able to derive its position, or the determined position will be inaccurate. Also some of the apparatus at the site may not be equipped with a first radio communication unit 30 at all.

Therefore, in order to further improve the reliability and versatility of the system, apparatus 12 can be equipped to perform a "signal strength triangulation" as described in the following. This triangulation allows to determine the mutual positions of several apparatuses at least approximately, even if one or more of them is unable to determine its position based on GNSS signals. The principles of this signal strength triangulation are described in the following.

The radio signal emitted by second radio communication unit 31 has a strength S that decays as a function of distance r. This decay can be approximated by a decay function d(r) with $$S(r)=S_0\cdot d(r). \tag{1}$$

For example, d(r) can, in far field approximation, decay with a negative power of r, i.e. d(r)=r⁻n, with n being 2 or larger.

In the following, it is assumed that a first apparatus A and a second apparatus B know their positions $p_A$ and $p_B$ and receive a device status dataset with a signal from a third apparatus C. The signal from apparatus C is lacking position information because apparatus C is unable to determine its position $p_C$. However, first apparatus A is able to measure the signal strength $S_{CA}$ of the signal that it receives from third apparatus C, and, similarly, the second apparatus B is able to measure the signal strength $S_{CB}$ that it receives from third apparatus C. If the distance between apparatus A and apparatus C is $r_{AC}$ and the distance between apparatus B and apparatus C is $r_{BC}$, the following set of equations applies:

$$S_{CA}=S_{0C}\cdot d(|p_C-p_A|) \text{ and}$$

$$S_{CB}=S_{0C}\cdot d(|p_C-p_B|), \tag{2}$$

with $S_{0C}$ being the original signal strength (i.e. the signal strength at zero distance) of apparatus C. Assuming that the vertical coordinates of the positions of all three apparatuses are equal (the devices are on a flat terrain), or assuming that the surface of the terrain is known (i.e. the vertical coordinate of an apparatus is a known function of its horizontal coordinates), and assuming that $S_{0C}$ is known as well, the set of two equations (2) has two unknowns, namely the horizontal coordinates of the position $p_C$ of apparatus C. Hence, in that case, the position $p_C$ can be basically calculated from the measured signal strengths $S_{CA}$ and $S_{CB}$. Hence, any apparatus that knows the positions $p_A$, $p_B$ as well as the signal strengths $S_{CA}$, $S_{CB}$ measured by apparatus A and apparatus B, can obtain an estimate of the position $p_C$ of apparatus C.

There may, however, be more than one solution to the set of equations (2), and, since the function d(r) will never be able to accurately reproduce the signal decay in arbitrary terrain, the solution of (2) may be inaccurate. To further improve accuracy, it is advantageous to generalize the case to N devices measuring a signal from a "third" apparatus j, in which case the signal strength $S_{ji}$ received by apparatus i from apparatus j is given by $$S_{ji}=S_{0j}\cdot d(|p_j-p_i|) \tag{3}$$

with i=1 . . . N and N>1. The equations (3) can be solved in approximation while minimizing the error in each equation using adjustment calculus, which allows to obtain a more accurate estimate for position $p_j$ if N>2, and to allow for variations of $S_{0j}$.

Hence, at least a subset of the apparatuses 12 can be designed to calculate the position $p_j$ of a "third" apparatus j if the device j does not deliver its position in its device status dataset. For this purpose, at least some or all of the apparatuses 12 should be adapted to broadcast the identities j and the signal strengths $S_{ji}$ of the signals received from other apparatus j by including this information in their device status dataset. Advantageously, the device status dataset of an apparatus i includes the identities j and the signal strengths Sji for of all (or at least part of the) apparatuses j that a signal was received from. The identity of the third apparatus j and its signal strength $S_{ji}$ can then be used by any other apparatus for estimating the position $p_j$ of apparatus j.

Further Notes

Memory 22 in apparatus 12 can also be used for storing the trajectory of the apparatus while it is being used, alarms issued during said trajectory, and/or other significant information for later retrieval and use, in particular e.g. for mining process analysis and improvement, statistical hazard analysis, etc.

The apparatus 12 can also use CORS data, in particular CORS data received by means of third radio communication unit 32, in order to improve the position measurement derived from the signals of first radio communication unit 30. CORS (Continuously Operating Reference Stations) data is provided by stationary reference stations located in or close to the site and allows to correct a position derived by GNSS signals, as described e.g. at www.ngs.noaa.gov/CORS/cors-data.html.

While there are shown and described presently preferred embodiments of the invention, it is to be distinctly understood that the invention is not limited thereto but may be otherwise variously embodied and practiced within the scope of the following claims.

The invention claimed is:

1. A collision warning apparatus comprising a positioning receiver for a radio based positioning system, said positioning receiver comprising a first antenna and first analog and first digital circuitry, a radio transceiver for sending and receiving radio messages to/from other collision warning apparatus, said radio transceiver comprising a second antenna, and second analog and second digital circuitry, an operator information unit for issuing collision warnings, a control unit processing data from said positioning receiver and said radio transceiver for generating said collision warnings, a roof mount unit for being mounted on a vehicle roof, wherein said first and said second antenna as well as said first and said second analog circuitry are arranged in said roof mount unit, a cabin mount unit for being mounted in a passenger cabin, wherein said operator information unit is arranged in said passenger cabin, a digital transmission line connecting said roof mount unit and said cabin mount unit, wherein said collision warning apparatus has an idle state and an active state, wherein, in said idle state, said collision warning apparatus has a smaller power consumption than in said active state, said collision warning apparatus further comprising an acceleration detector, wherein said control unit is adapted to put said collision warning apparatus into said active state upon detection of an acceleration by said acceleration detector.

2. The apparatus of claim 1 wherein said operator information unit comprises a display and/or a loudspeaker.

3. The apparatus of claim 1 wherein said digital transmission line is wirebound.

4. The apparatus of claim 1 wherein said digital transmission line is a wireless link.

5. The apparatus of claim 1 wherein said roof mount unit comprises a first attachment for mounting said roof mount unit to the vehicle roof.

6. The apparatus of claim 5 wherein said first attachment comprises a magnet for mounting said roof mount unit to the vehicle roof.

7. The apparatus of, claim 5 wherein said roof mount unit comprises a base section and a head section, wherein said base section comprises said first attachment and batteries and said head section comprises said first and second antenna.

8. The apparatus of claim 1 wherein said cabin mount unit comprises a second attachment.

9. The apparatus of claim 8 wherein said second attachment comprises a suction cup for mounting said cabin mount unit in said passenger cabin.

10. The apparatus of claim 1 further comprising a third radio communication unit for communicating through a wireless data transmission network in addition to said radio transceiver, wherein said third radio communication unit comprises a third antenna, and third analog and third digital circuitry, wherein said third antenna and said third analog circuitry are arranged in said roof mount unit.

11. The apparatus of claim 1, wherein said control unit is arranged in said cabin mount unit.

12. The apparatus of claim 1, wherein said control unit is adapted to issue on the operator information unit not only collision warnings but also further information.

13. The apparatus of claim 12, wherein said further information to issue on said control unit includes parameters depending on location or speed.

14. The apparatus of claim 1, wherein said control unit is adapted and structured to have an alert mode that can be activated by a user of said apparatus, and wherein said control unit is adapted to emit, through said radio transceiver an apparatus status dataset comprising a flag indicative of whether said apparatus is in said alert mode.

15. The apparatus of claim 1 comprising at least one rechargeable battery and an inductive coupler for inductively coupling energy into said battery.

16. The apparatus of claim 1 wherein said positioning receiver is disabled in said idle state and operating in said active state.

17. A method for operating an apparatus of claim 1 comprising the steps of mounting or unmounting said roof mount unit on a roof of a vehicle and mounting or unmounting said cabin mount unit in a passenger cabin of said vehicle.

18. The method of claim 17 further comprising the steps of obtaining a position of said apparatus by means of said positioning receiver, comparing said position to a predefined geographical area and, if said position is not within said predefined geographical area, further comprising the step of issuing at least one warning message.

19. The method of claim 18 wherein said warning message, is issued on said operator information unit, or sent to a central server, and/or said apparatus is made unusable.

20. The method of claim 17 further comprising the steps of sending a message from a central server to said apparatus using a cellular phone network, receiving said message by said apparatus and issuing said message on said operator information unit.

21. The method of claim 17 further comprising the step of storing a trajectory of said apparatus, alarms issued during said trajectory, and/or other information for later retrieval and use.

22. The method of claim 17, wherein at least one receiver device is located at an actuator, wherein, if said receiver device detects a proximity of the apparatus, said receiver device actuates said actuator after testing access rights of an object attributed to said apparatus.

23. The method of claim 17 comprising the steps of measuring, by at least a first apparatus, a signal strength ($S_{ji}$) of a signal received from a second apparatus, and transmitting, by said first apparatus, an identity (j) of a third apparatus and said signal strength ($S_{ji}$), receiving said identity (j) and said signal strength ($S_{ji}$) by a second apparatus and estimating a position of said third apparatus therefrom.

24. The method of claim 17 comprising steps of obtaining a position of said collision warning apparatus by means of said positioning receiver, storing said position of said collision warning apparatus in a first device status dataset of said collision warning apparatus, wherein said first device status dataset comprises a unique identifier of said collision warning apparatus, and transmitting said first device status dataset as a radio message by means of said radio transceiver.

25. The method of claim 24 further comprising steps of receiving by means of said radio transceiver of said collision warning apparatus a second device status dataset of another collision warning apparatus, wherein said second device status dataset comprises a position of said other collision warning apparatus, and calculating a distance (d) between said collision warning apparatus and said other collision warning apparatus using said position of said collision warning apparatus and using said second device status dataset.

* * * * *